US008207897B2

(12) United States Patent
Alvey et al.

(10) Patent No.: US 8,207,897 B2
(45) Date of Patent: Jun. 26, 2012

(54) RADIO DEVICE AND SLOT ANTENNA WHICH FACILITATES OPERATION OF A USER INTERFACE ELEMENT

(75) Inventors: Graham R. Alvey, Skokie, IL (US); Paul R. Steuer, Hawthorn Woods, IL (US); James A. Van Bosch, Crystal Lake, IL (US); Louis J. Vannatta, Crystal Lake, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 588 days.

(21) Appl. No.: 12/338,637

(22) Filed: Dec. 18, 2008

(65) Prior Publication Data

US 2010/0156728 A1 Jun. 24, 2010

(51) Int. Cl.
*H01Q 1/24* (2006.01)

(52) U.S. Cl. ..... 343/702; 343/767

(58) Field of Classification Search ..... 343/700 MS, 343/702, 767
See application file for complete search history.

(56) References Cited

U.S. PATENT DOCUMENTS

| | | | | |
|---|---|---|---|---|
| 5,757,326 | A * | 5/1998 | Koyama et al. | 343/702 |
| 6,266,538 | B1 * | 7/2001 | Waldron | 455/575.7 |
| 6,282,433 | B1 | 8/2001 | Holshouser | |
| 7,034,762 | B2 | 4/2006 | Huang | |
| 2005/0058280 | A1 * | 3/2005 | Ma | 379/430 |

FOREIGN PATENT DOCUMENTS

| | | | |
|---|---|---|---|
| EP | 0851530 | A2 | 7/1998 |
| WO | 2006120250 | A2 | 11/2006 |

* cited by examiner

*Primary Examiner* — Dieu H Duong
(74) *Attorney, Agent, or Firm* — Patents on Demand, P.A.; Scott M. Garrett

(57) ABSTRACT

A portable communication device (100, 800, 900) has an antenna element (102, 1206). The antenna element forms a slot (104, 1208) which is used as a slot antenna. The device is configured such that the slot facilitates operation of a user interface element through the slot.

20 Claims, 8 Drawing Sheets

800

900

1000

1100

RADIO DEVICE AND SLOT ANTENNA WHICH FACILITATES OPERATION OF A USER INTERFACE ELEMENT

FIELD OF THE INVENTION

The invention relates generally to portable communication devices, and more particularly to antenna arrangements for portable communication devices.

BACKGROUND OF THE INVENTION

Portable communication devices are in widespread use, and are available in a variety of configurations. In recent years, design constraints have been pushed by market pressure, resulting in such devices generally decreasing in size as successive products are brought to market. Furthermore, consumers of these devices have favored devices having no significantly noticeable external antenna as well as devices with metallic or metallized housings. These design constraints have presented substantial challenges to designers of these devices with regard to the antenna design. External whip-type antennas typically have better overall performance in terms of gain compared to internal antennas. However, many advances have been made in the design of internal antennas for portable communication devices, which has resulted in an acceptable level of performance, at least in devices using plastic housing materials. The introduction of metal and metallized housing materials has presented an additional challenge in the design of internal antennas for communication devices.

In some cases, this problem has been alleviated by using the metallized housing itself as part of the antenna radiating structure. However, the size and shape of such housing elements do not always fall in line with optimum or even acceptable antenna geometry. Furthermore, the major surfaces of these devices, if used as part of the radiating structure, are often oriented such that during use they are substantially coplanar with the user's body. In some applications, such orientation may be desirable, but in others, such as wireless earpieces which link to a device typically worn at the user's waist, the orientation may reduce the effectiveness of the antenna. Accordingly, there is a need for an antenna structure for portable communication devices which addresses these problems associated with the prior art.

SUMMARY OF THE INVENTION

The invention provides, in one embodiment, a radio device that includes an antenna element comprised of at least one of an internal element or a conductive portion of a housing element. The antenna element has a radiating slot formed through the antenna element. The device includes a circuit module which carries circuitry and components for operation of the radio device. The slot of the antenna element facilitates operation of a user interface component of the device though the slot, where the user interface element is externally accessible to users of the device though the slot.

The invention further provides, in an alternate embodiment, a housing for a radio device. The housing includes a conductive portion which forms a radiating slot tuned to an operating frequency of the radio device. The radiating slot is configured to allow operation of a user interface component of the radio device through the radiating slot.

The invention may be embodied in a wireless earpiece communications accessory device, which includes an antenna element which forms a slot antenna. The device includes a circuit module disposed inside the device, and having at least one user interface element disposed in the circuit module which is operable by a user through the slot antenna. Furthermore, when the device is worn on a user's body, the device is in an orientation such that the electric field of the slot antenna is polarized generally perpendicular the surface of the user's skin.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

While the specification concludes with claims defining features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The invention solves the problem of providing both a suitable antenna structure as well as access to user interface elements in a compact radio communication device having an antenna element forming a slot antenna which allows user access to an operational component of the device, such as a user interface element, through the slot of the slot antenna. The antenna element may be an internal element, or formed of a metallic or metallized housing or housing portion of the device, or both. By use of one or more radiating openings formed in the antenna element, and arranging the user interface components such that they are accessible through the radiating opening(s), the user is able to operate the device.

Figure 1:
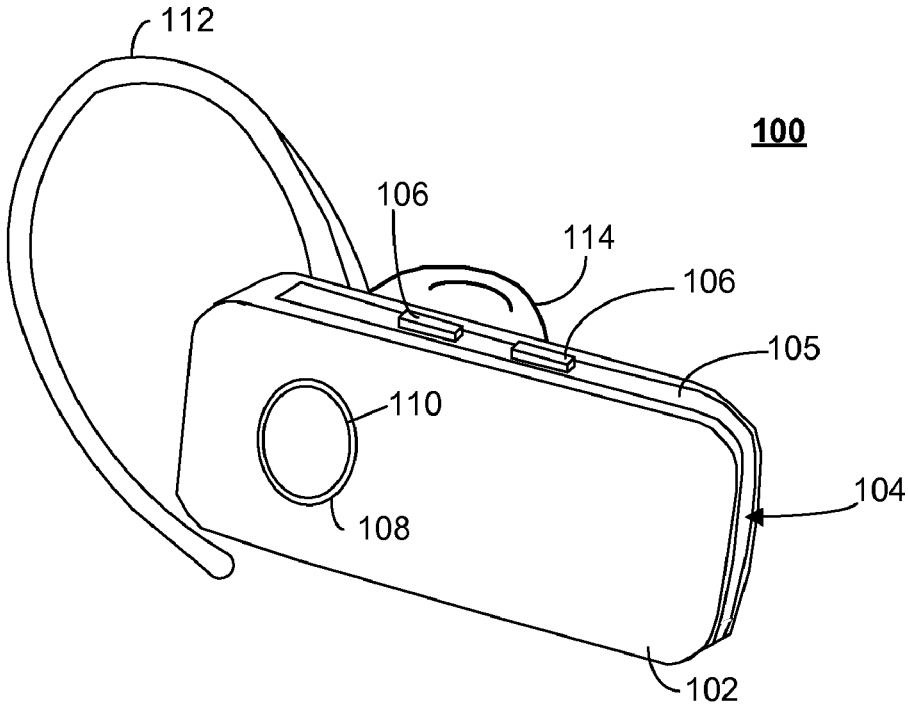
FIG. 1 shows a portable communication device in the form of a wireless earpiece designed in accordance with an embodiment of the invention.

FIG. 1 shows a portable communication device 100 in the form of a wireless earpiece, designed in accordance with an embodiment of the invention. The present embodiment uses an external antenna structure formed by at least a portion of the housing. The device has a housing 102 which is made of an electrically conductive or simply conductive material. An opening in the form of a slot 104 is formed in the housing. The slot is formed by the absence of conductive material. That is, the slot may be comprised of any suitable material, including air, which is of sufficiently low conductivity to produce the desired radiating slot result. A circuit module 105 is disposed within and housed by the housing, and has user interface elements, such as buttons 106 which are operable though the slot opening 104. The slot 104 is configured to be a radiating aperture for antenna operation. An example of a radiating aperture is a slot antenna. Slot antennas are typically formed by cutting a slot in a relatively thin conductor member, wherein the slot length is related to the operating frequency wavelength, typically a half wavelength ($\lambda/2$) or a quarter wavelength ($\lambda/4$), although other configurations may be used, as is known. The slot width is selected to be much smaller than the slot length and may be tapered. Generally, by much smaller it is meant on the order of less than $1/10^{th}$ the length of the slot. The field produced by a slot antenna is very similar to that of a dipole having equal dimensions except the polarization directions of the electric and magnetic fields are reversed.

The circuit module comprises at least one user interface element, such as buttons 106. A user interface element is any element which allows the user to receive information from or provide input to the device, such as by audible, visual, or tactile means, and includes components such as buttons, dials, keypads, visual indicators, acoustic transducers (speakers and microphones), graphical displays, and so on. In the present example, buttons 106 may be, for example, volume control buttons, where one button increases volume and the other decreases volume when pressed. It is further contemplated that the housing 102 may further comprise at least one non-radiating opening 108, through which another user interface element, such as button 110, may be accessible or otherwise operable by a user of the device. In the present example, the device is a wireless earpiece which is to be used, for example, with a cellular phone, via a personal area network link, such as that known by the trade name "BLUETOOTH," and described in the Institute of Electrical and Electronic Engineers' (IEEE) specification No. 802.15.1. Other known wireless networking protocols may be used equivalently, including IEEE 802.11 for wireless local area networking, and that known as the Digital European Cordless Telecommunications (DECT) standard, published by the European Telecommunications Standards Institute (ETSI). As embodied in a wireless earpiece the device may optionally have an ear clip retainer 112 which fits over the ear to hold the device in place against the ear such that an earcup 114, which houses a speaker, is properly aligned with the ear canal for optimized listening.

The circuit module comprises radio transceiver circuitry for transmitting and receiving voice and control signals between the device and a host, such as a cellular phone. The circuit module further comprises software components to establish, maintain, and operate a radio link with the host, including, for example, operating the link in a low power mode when the link is idle. Additionally, the circuit module may have audio processing components for receiving acoustic signal from the user of the device, such as at a microphone, and converting them into a transmittable signal. The audio components may include a speaker for playing audio signals received from the host for the user to hear. In addition to the audio components, the circuit module may include additional input and output components such as circuits for receiving control input from the user via buttons, and for providing output to the user such as by visual indicators or graphic displays. Radio signals are fed to the radiating slot 104 via a conductive connector means disposed between radio circuitry on the circuit module and the conductive housing at a point near the opening 104. In feeding a slot radiator, the radio frequency signal may be applied across the slot. That is, at corresponding points along the long sides of the slot, across from each other. Various techniques are known for tuning slot radiators including, for example, use of a capacitive stub between the long sides of the slot, adjusting the thickness of the conductive housing, and adjusting the feed points along the long edges of the slot. Such techniques may be used to properly tune a slot radiator of a particular configuration for a particular application. For example, the device shown in FIG. 1 uses a wrapped slot which runs along the top side and down the right side of the device, with the buttons 106 protruding through the slot along the top side of the device.

Figure 2:
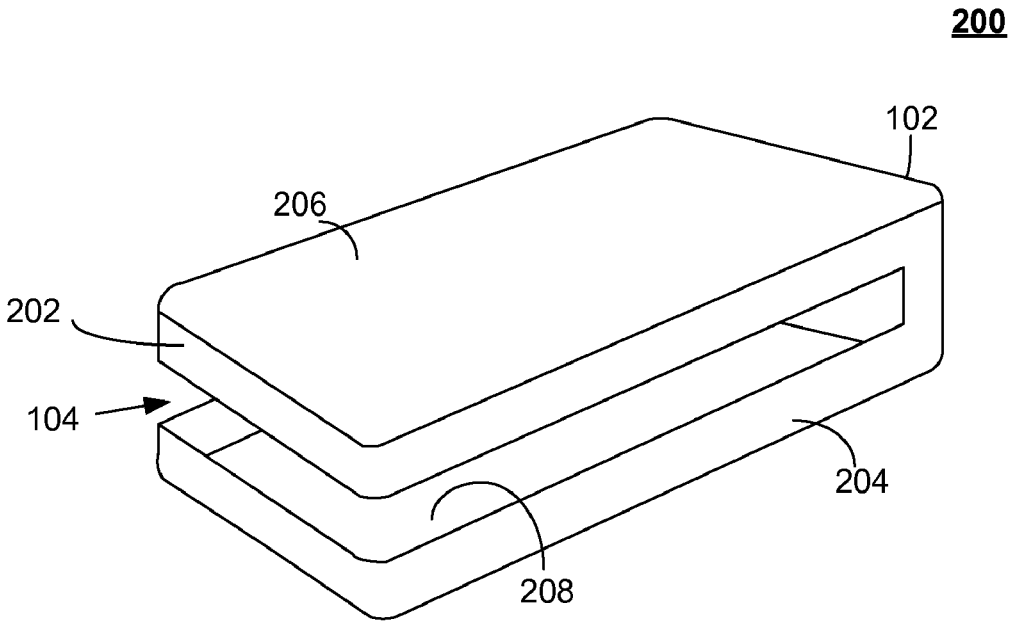
FIG. 2 shows a conductive housing member for use with a radio device, in accordance with an embodiment of the invention.

FIG. 2 shows a different isometric view 200 of a conductive housing 102 having a slot radiator 104 for use with a radio device, in accordance with the invention. The housing shown here may be similar to the housing used in FIG. 1, although the dimensions are not necessarily to scale, and have been adjusted for the sake of clarity in the drawing. The present exemplary housing has opposing edges 202 and 204 formed along the edges of opposing sides or surfaces 206 and 208. It should be noted that the edges 202 and 204 are not coplanar with the opposing surfaces 206 and 208, but are formed at angle which defines the side edges of the housing. The slot is configured to facilitate operation of, for example, a user interface component though the slot, by locating the slot on the housing in a location which corresponds to user interface components on the circuit module. It will further be appreciated, as can be seen in FIG. 2, that the slot 104 wraps around the side edges of the housing. The opposing sides and edges form a cavity within the housing into which the circuit module will placed and retained. The edges 202 and 204 may further act as retaining features for retaining the circuit module.

Figure 3:
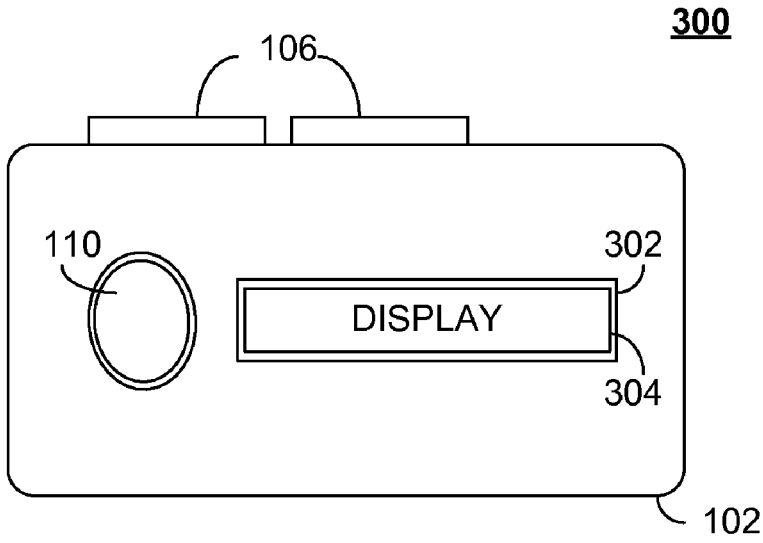
FIG. 3 shows a side view of a radio device having a radiating opening, in accordance with an embodiment of the invention.
Figure 4:
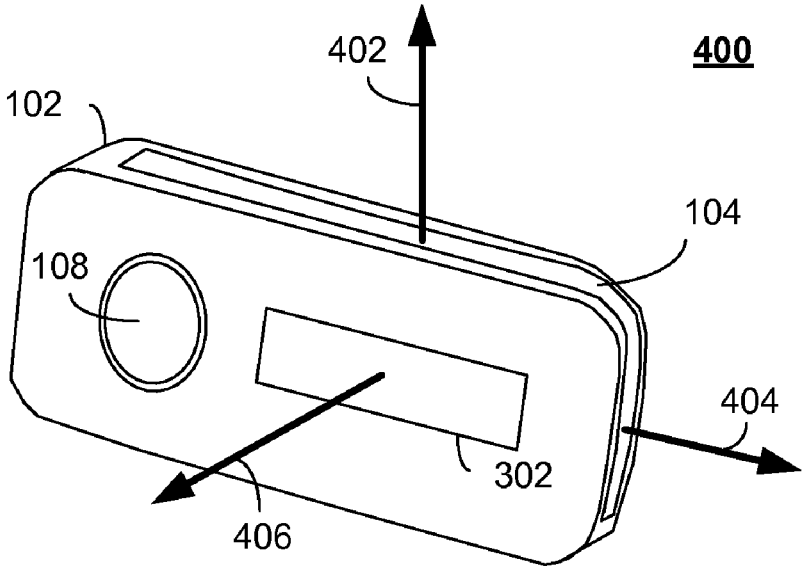
FIG. 4 shows a conductive housing member and propagation directions of radiating openings of the housing member, in accordance with an embodiment of the invention.

FIG. 3 shows a side view of a radio device 300 having a second radiating slot 302 formed on one of the major surfaces of the housing. The radiating slot 302 is therefore oriented in a different orientation than first slot radiator 104. An additional user interface element, such as a graphic display 304, may be disposed within the additional radiating slot 302, and made visually accessible to a user through the radiating slot 302. Other user interface elements may also, or alternatively, be made accessible through radiating slot 302. Note that buttons 106 can be seen here protruding from the top of the device, through slot 104. Using a second or other additional radiating slots provides diversity performance. For example, since radiating slots are directional radiators, orienting multiple radiating slots in different orientations provides directional or polarity diversity. Furthermore, by tuning different slots to different operating frequencies, the device may be provided with frequency diversity. FIG. 4 shows an isometric view 400 of a housing similar to that used for the device shown in FIG. 3. The first radiating slot 104 radiates primarily along axes 402 and 404, whereas second radiating slot 302 radiates primarily in the direction of axis 406. In addition to the radiating openings, other, non-radiating openings may be provided or formed in the housing, such as non-radiating opening 108. Non-radiating opening 108 may be configured to reduce any radiation from the opening, such as by geometry of the opening, as well as feed point selection for the radiating openings such as openings 104 and 302.

Figure 5:
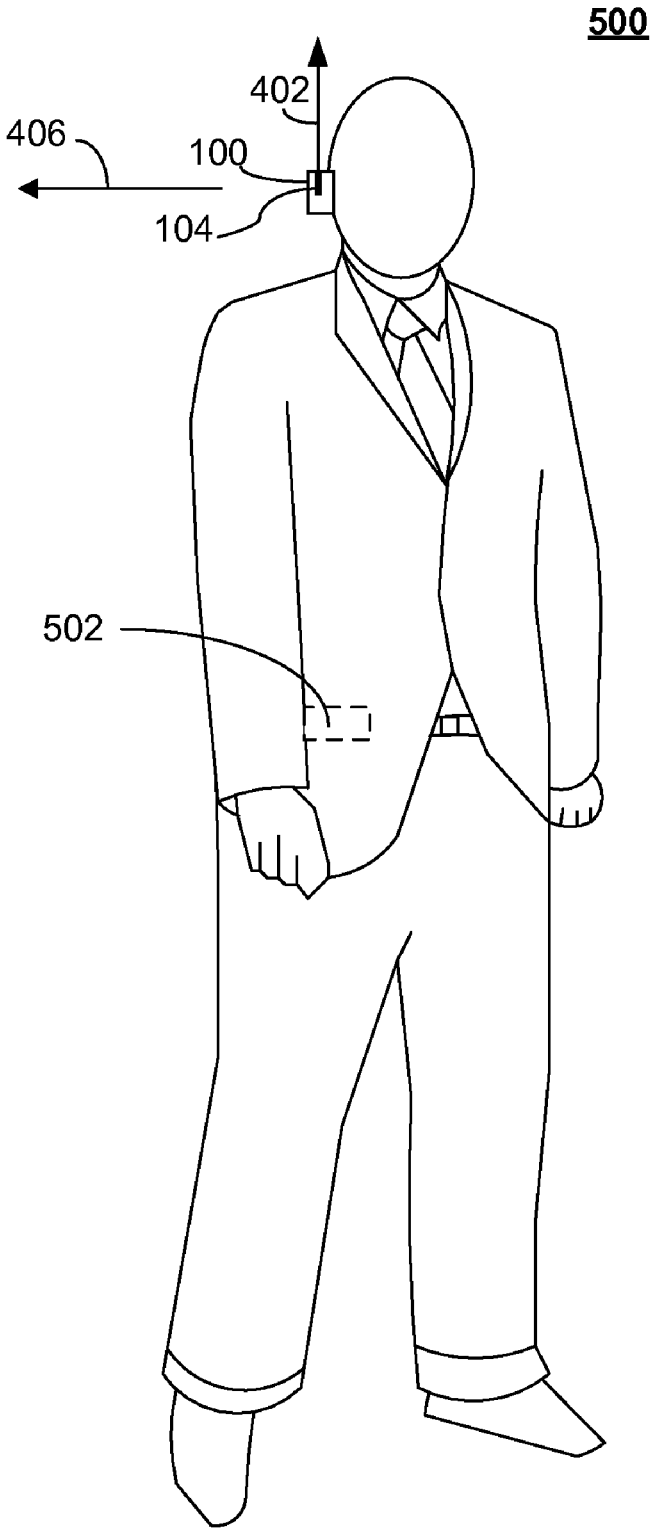
FIG. 5 shows a radio device being worn by a user in accordance with an embodiment of the invention.

The polarity of the radiating slots may be beneficially used in certain applications. For example, the portable communication device may be a wireless earpiece using a low power personal area network link, as shown in FIG. 5. FIG. 5 shows a body diagram 500 radio device 100 being worn by a user in accordance with an embodiment of the invention. The way the device is oriented when worn normally the resulting orientation of the radiating slot polarizes the radiation in a direction perpendicular to the body of the user. In the present example, slot radiator 104 would produce radiation along axis 402, substantially vertically with an electric field polarization along axis 406, which is substantially horizontal. Since the user typically wears the host phone device 502 at their waist, radiation along axis 402 with polarization along axis 406 directs energy towards the host device 502, which allows the devices to operate using less power to maintain the radio link between them. Additional radiator slots may be used for spatial, frequency, or orientation diversity.

Figure 6:
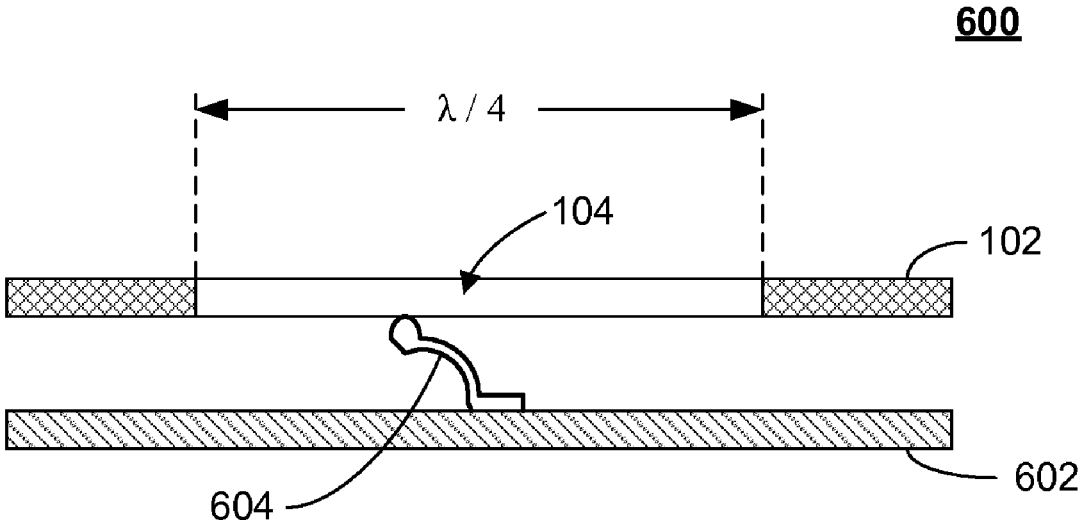
FIG. 6 shows a cut-away view of a coupling contact between a circuit board and a conductive housing member for feeding a radiating opening, in accordance with an embodiment of the invention.

Referring now to FIG. 6, there is shown a side cut-away view of a portion 600 of a device designed in accordance with an embodiment of the invention. The present view shows an exemplary feed structure for feeding or otherwise coupling to the conductive housing from the circuit module. In particular, the circuit module comprises a substrate 602 such as a printed circuit board. The circuit board carries circuitry and components. The conductive housing 102 has a radiating slot 104 formed through the housing. The entire housing need not be conductive, only the portion in which the slot is formed needs to be conductive. A shield (not shown) may be disposed between the substrate and housing to prevent the circuitry on the substrate from electromagnetically coupling to the housing when the device is transmitting. To feed the signal from circuitry on the substrate to the conductive housing, a contact 604 may be used to make electrical contact with the housing. As shown here, the contact 604 will be deeper into the page than the back edge of the slot, such that the contact will be pressing against the inside of the housing. Contact is maintained by pressure between the contact head and the back or inside of the housing. In the present embodiment, the contact is a spring contact, formed by a cantilevered conductive member. The transmission qualities of the contact will be taken into account when designing the contact and the slot radiator. Alternatively, other types of spring contacts may be used, such as a pogo pin, for example. Furthermore, other types of feeding structures may be used which do not rely on spring force, such as coupling a short section of coaxial cable between the substrate and housing, or means of capacitively or inductively coupling RF energy into the slot structure from the substrate, such as non-contacting microstrip lines, non-contacting loops on the substrate.

Figure 7:
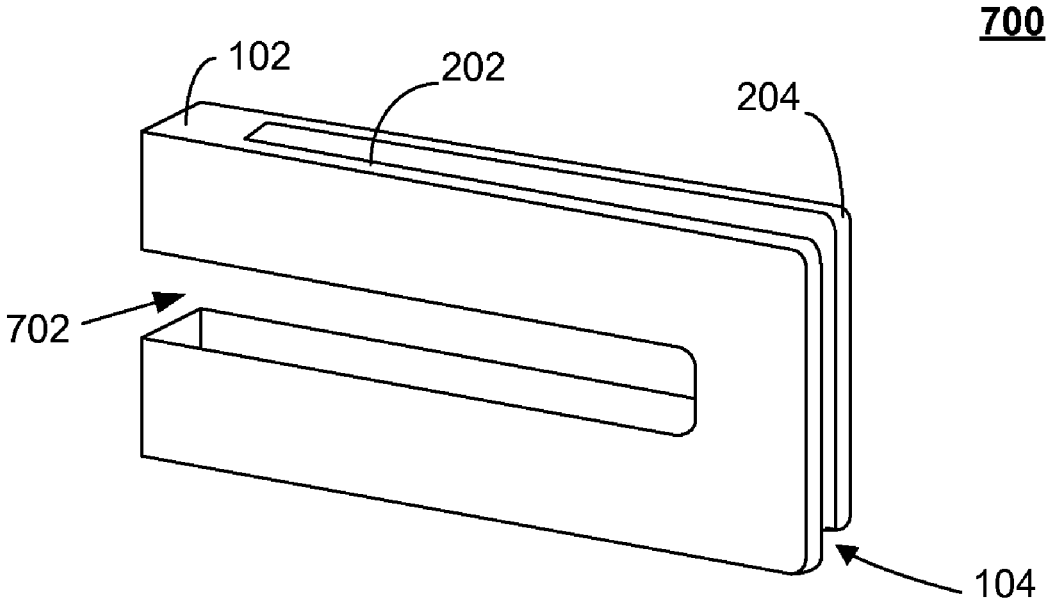
FIG. 7 show an isometric view of a conductive housing having interposed wrapped slot antennas formed in the housing, in accordance with an embodiment of the invention.

FIG. 7 shows an alternate housing 700 which provides antenna diversity in accordance with an embodiment of the invention. The conductive portion of the housing 102 comprises a first radiating slot 104, formed around the edges of the housing, as in FIGS. 1-2. FIG. 3 shows the inclusion of a shorter slot antenna 302 which may be used to provide frequency diversity, allowing the device to operate in multiple frequency bands. The present exemplary housing includes a second slot antenna 702 which is formed in an interlocking "U" configuration with the first slot antenna 104. The second slot antenna wraps around the housing from the front face, around the left edge, and continues around the back face of the housing. The second slot 702 may be configured to have substantially similar characteristics to the first slot 104 to provide spatial diversity. As previously mentioned, it is not required that the entire housing be fabricated of conductive material. Only the portion or portions which form the slot radiator elements and specifically the areas adjacent the slot(s) be made of conductive material. The amount of area required around the slot may be different for different applications and configurations.

Figure 8:
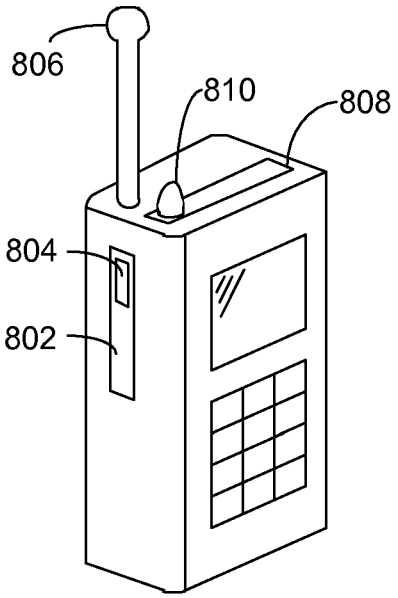
FIG. 8 shows a hand-held radio device using an antenna and user interface elements, in accordance with an embodiment of the invention.
Figure 9:
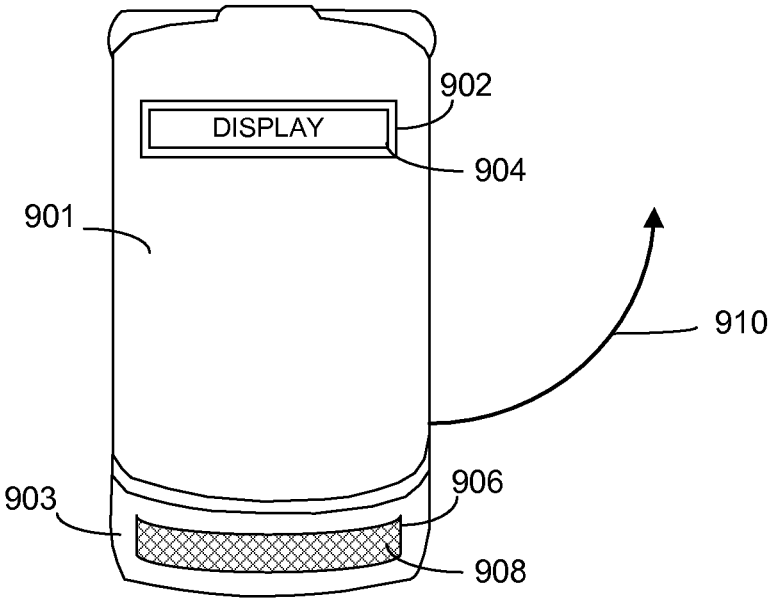
FIG. 9 shows a cellular phone using an antenna and user interface elements, in accordance with an embodiment of the invention.

FIGS. 8 and 9 show two of several alternate embodiments of the invention. FIG. 8 shows a two-way radio 800, such as those used by public safety and law enforcement personnel. Two-way radios are characterized by "push to talk" operation. It is also common for two-way radios to be used with accessories, such as remote microphone units which are commonly worn on the user's upper torso, near their shoulder, where they can easily talk into the remote microphone unit. Remote microphone units are conventionally coupled to the two-way radio via a cable, but they are increasingly being designed to use a wireless personal area network link with the two-way radio host. The remote microphone unit (not shown) may incorporate a slot antenna and user interface arrangement as shown, in accordance with the invention. Furthermore, the two-way radio may have, for example, a slot radiator 802 formed in a conductive portion of the side plate of the radio through which a push to talk button 804 protrudes. The slot antenna 802 may be used to link with accessory devices, while a whip antenna 806 is used for higher power communication. Instead of, or in addition to the side slot antenna 802, the radio may use a top-side slot antenna 808 formed in a conductive portion around the top knob/switch assembly, and through which a knob 810 may protrude and be operable by the user.

FIG. 9 shows an example of a conventional "clam" style or folding cellular communication device 900. As is increasingly common, the cellular device has metal or metallized housing members 901 and 903. It is also increasingly common for such devices to have no visible antenna, and to be used with wireless, personal area networked accessories, such as the wireless earpiece of FIGS. 1 and 3. A first radiating slot 902 is formed through housing member 901. A graphic display 902 is mounted so as to be visible through the radiating slot 902. The radiating slot may be fed via a connection inside the flip portion of the device which opens upwards, as indicated by arrow 910, when the device is unfolded. Radiating slot 902 is just an example of where such a slot maybe located, and display 904 is an example of a user interface component which may be operable through the slot. Additionally, or alternatively, a radiating slot maybe located elsewhere on the device, such as radiating slot 906 formed through housing member 903, in a lower portion of the main body of the device. Mounted within the device, behind the slot, is a speaker, covered by speaker grill 908. The speaker is positioned specifically to produce acoustic waves through the radiating slot 906, and the cavity in which the speaker is mounted may be acoustically sealed from the other portion of the device. The speaker may be used, for example, as a loudspeaker for operating the device in a speakerphone mode. Acoustic audio waves are propagated out of the device, from the speaker, and through the slot 906. It may be noted that the slot shape may somewhat conform to the contours of the housing. Furthermore, in the case where both slots 902 and 906 are provided, the two slot antennas may provide diversity, particularly when the folding device is opened and used as a phone. Although the use of such slot antennas has been discussed here with regard to personal area networking, it is contemplated that such slot antennas may be used for other radio communication, such as cellular communications, which may operate at different frequencies than personal area networking. As such, a slot radiator may be used as an alternative to an external whip-type antenna or an internal antenna in devices with metal or metallized housings.

Figure 10:
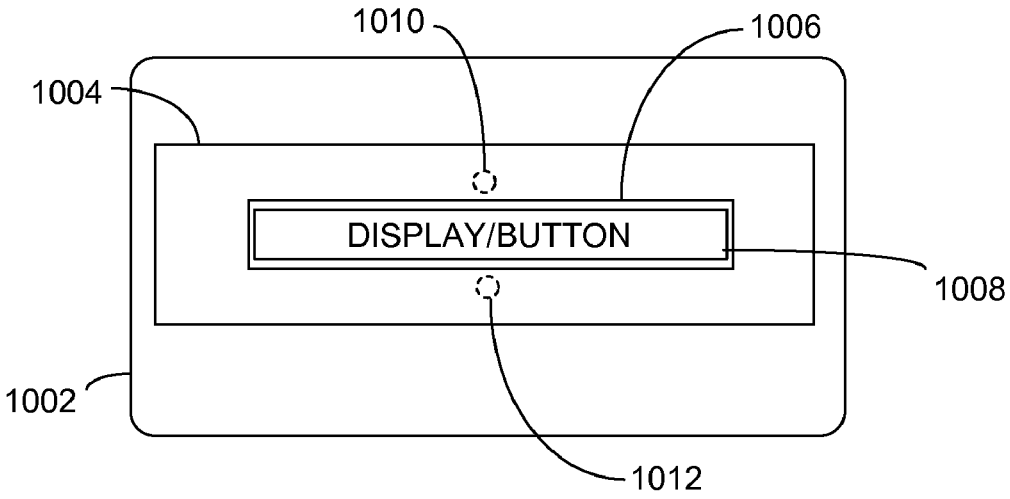
FIG. 10 shows a side view of a radio device having a conductive member forming a slot antenna on an external surface of the housing of the radio device, in accordance with an embodiment of the invention.
Figure 11:
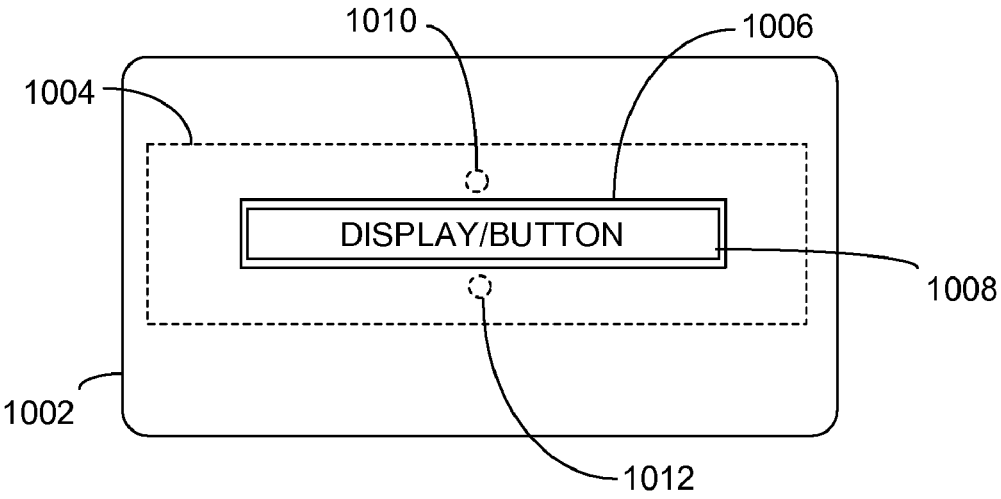
FIG. 11 shows a side view of a radio device having a conductive member forming a slot antenna on an internal surface the housing of the radio device, in accordance with an embodiment of the invention.

FIGS. 10 and 11 show side views of a radio device having a conductive member forming a slot antenna on an internal and external surface, respectively, of the housing of the radio device, in accordance with an embodiment of the invention. In the embodiment of the invention present here, the slot antenna is formed in a conductive member which is mounted on or adjacent a housing member 1002. The housing member may be made of an electrically insulating material, such as plastic. The housing member 1002 has an opening 1006, which is substantially the same size and shape as a slot formed in the conductive member 1004. The conductive member is positioned such that the slot in the conductive member corresponds with the opening 1006, although it may be larger than the opening in the housing. A user interface component 1008, mounted or otherwise disposed on a circuit module inside the radio device is accessible through the opening 1006 and the slot of the conductive member 1004. The user interface component may be a display or a button or any other such component for interacting with or controlling operation of the radio device. The slot of the conductive member 1004 may be operated as a slot antenna by feeding an RF signal to the conductive member and grounding the conductive member at appropriate points, such as points 1010 and 1012. In FIG. 10, the conductive member resides on the external surface of the housing, and may be, for example, a thin metal bezel-type element which sits in a recessed area of the housing, so its outer surface lies flush with surrounding surface of the housing. The conductive element may be a foil-type material which is adhesively affixed to the housing. FIG. 11 simply shows, by virtue of the broken line, that the conductive element 1004 may be internal to the radio device, such as by mounting the conductive element against the internal surface of the housing, although it is contemplated that the conductive member may simply be disposed proximate or adjacent to the housing without actually being mounted on the internal surface of the housing. It is also contemplated that the conductive member may be molded into the housing, such that conductive element is inside the housing wall, where it may be fed with direct contact, or through inductive or capacitive coupling. Although shown here as being disposed only on one side of the housing, it is contemplated that the conductive member may wrap around the housing. It will also be appreciated that the opening in the housing 1006 only needs to be large enough to accommodate the user interface element 1008, while the slot in the conductive member may be larger. This would allow the slot to wrap around the housing without requiring the housing to be similarly slotted, which allows for a more rigid housing. It is further contemplated that, when multiple user interface elements are accessible though the slot, each user interface element may be accessible through a separate opening in the housing. That is, there may be a plurality of openings for a plurality of user interface elements, with each of the plurality of openings located along the slot in the conductive member. The conductive member may be formed by a section of a flexible circuit board, or any other suitable conductive surface, including the surface of a battery cell used to power the radio device.

Figure 12:
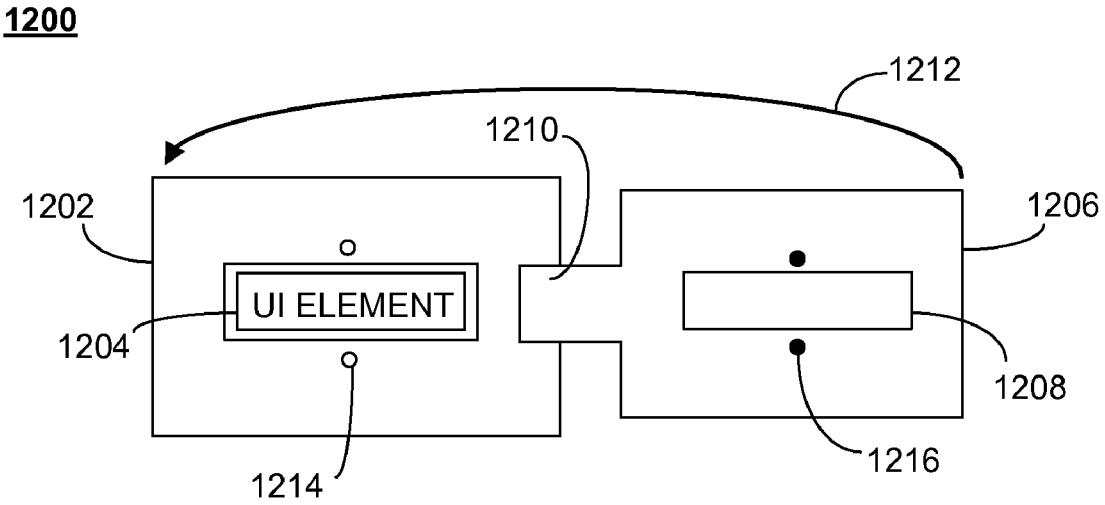
FIG. 12 shows a circuit module using an internal slot antenna formed with a flexible circuit board attached to the circuit, in accordance with an embodiment of the invention.
Figure 13:
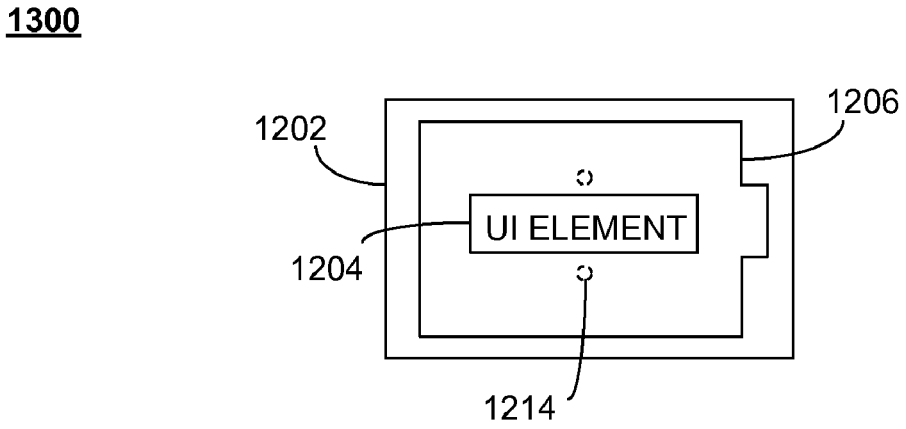
FIG. 13 shows a circuit module using an internal slot antenna formed with a flexible circuit board where the flexible circuit board is folded over the circuit module, in accordance with an embodiment of the invention.

Referring now to FIG. 12, there is shown a circuit module 1200 using an internal slot antenna, in accordance with an embodiment of the invention. The invention may also be embodied in a device using an internal slot antenna wherein user interface elements are accessible through the slot of the antenna. For example, a circuit board 1202 may be used to carry a user interface element 1204, such as a graphical display, buttons, or a combination of such user interface elements. A slot antenna may be disposed over the circuit board, where the slot of the antenna aligns with, corresponds to, or otherwise accommodates the user interface element 1204. For example, a flexible circuit board 1206 having a slot 1208 may be attached to the circuit board at point 1210. The flexible circuit board is folded over the circuit board, as indicated by arrow 1212, for assembly, resulting in the view shown in FIG. 13. FIG. 13 shows the circuit module in a folded state 1300, with the user interface element 1204 accessible through the slot 1208 of the flexible circuit board 1206. Contacts on the circuit board, such as contact 1214, may be used to feed and ground the antenna structure at corresponding points on the flexible circuit board, such as point 1216. Generally, the flexible circuit board may be a laminate structure comprising a layer of conductor between layers of insulating material such as polyamide, as is well known. To facilitate contact with the conductive layer, point 1216 may comprise an opening in an insulating layer to expose the conductive player. It will be appreciated by those skilled in the art that the flexible circuit board of the present example may be sized and shaped in a variety of configurations. For example, as shown in FIG. 12, the flexible circuit board 1206 and slot 1208 may be extended to the right, lengthening the antenna structure, such that it may be wrapped around the left side of the circuit board, thereby covering both sides, or at least the front side (shown) and a portion of the backside, with the slot extending around the circuit board as well. Furthermore, it is contemplated that the slot 1208 may be extended, for example, in FIG. 12, to the right, such that the slot is open-ended, resulting in a quarter wavelength implementation. The flexible circuit board would then have a substantially "U" shape. Additionally, as with the embodiment where the housing is conductive, and comprises a non-radiating opening, the flexible circuit board may likewise have a non-radiating opening through which an additional user element is made accessible.

Figure 14:
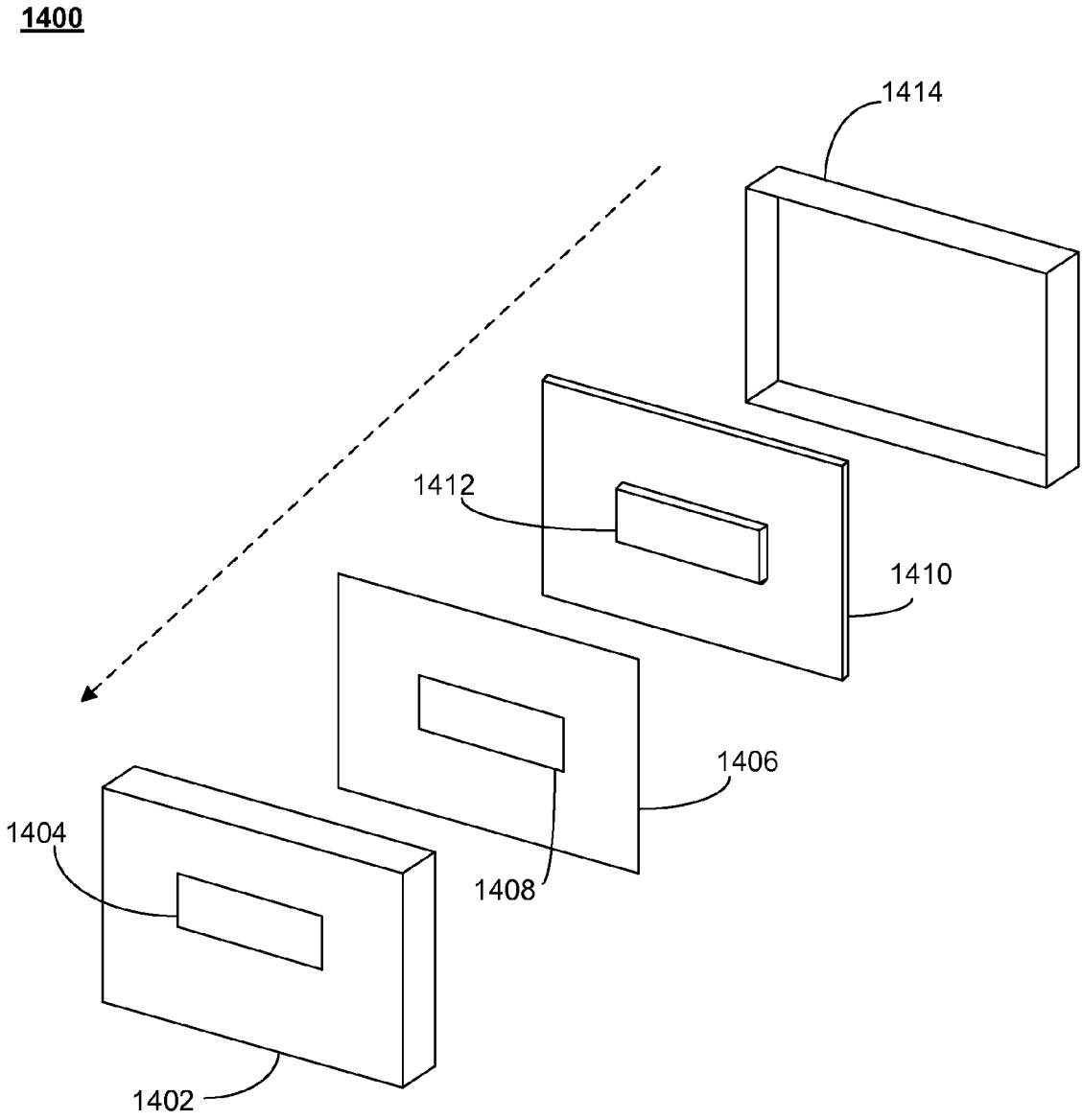
FIG. 14 shows an isometric view of a radio device assembly using an internal slot antenna in accordance with an embodiment of the invention.

Referring now to FIG. 14, there is shown an isometric exploded view 1400 of a radio device using an internal slot antenna, in accordance with an embodiment of the invention. Many of the details of the device have been excluded for simplicity. The radio device generally has a first housing member 1402, which has a slot or opening 1404. An antenna element 1408 is contained within the device, on the inside of the housing, and has a slot 1408 which at least partially corresponds to slot 1404. The radio device further comprises a user interface element 1412, which may be disposed on a circuit board 1410, and which aligns with slots 1408 and 1404 such that when the device is assembled, a user can access user interface element 1412 through the slots. A second housing member 1414 mates with the first housing member to enclose the antenna element 1406 and circuit module or board 1410. The antenna element 1406 may be fed from the circuit board using conventional means such as those discussed herein previously. While in this embodiment, having an internal antenna element, the housing may be made of a non-conductive material, it is also contemplated that the housing may be a conductive material, and the internal element 1406 may be used to capacitively couple to the housing, wherein the slot 1404 of the housing would be a radiating opening. When assembled, the device will resemble the device shown, for example, in FIG. 3.

Accordingly, the invention thereby solves the problem of accommodating good antenna performance in small, portable communication devices which a user operates or interacts with through user interface components of the device. Generally, a radiating slot is used as a slot antenna, wherein the slot facilitates a secondary purpose or operation unrelated to antenna operation, such as operation of a user interface element or component thought the opening formed by the slot. This invention can be embodied in other forms without departing from the spirit or essential attributes thereof. Accordingly, reference should be made to the following claims, rather than to the foregoing specification, as indicating the scope of the invention.

What is claimed is:

1. A radio device, comprising:

a housing forming an antenna element having a first radiating slot formed therein, the housing including two opposing coplanar electrically conductive surfaces, each of the opposing surfaces having edges that define sides of the device, the first radiating slot formed between the edges and wrapping around the device on at least two contiguous sides of the device;

a circuit module housed within and retained by the housing;

a first user interface component disposed on the circuit module, and operable though the first radiating slot;

a second radiating slot formed on at least one of the opposing surfaces;

a second user interface component disposed on the circuit module and operable through the second radiating slot;

a non-radiating opening formed in the opposing surface having the second radiating slot; and a third user interface component disposed on the circuit module and operable through the non-radiating opening.

2. The radio device of claim 1, wherein the first user interface component comprises at least one of a button, or an acoustic transducer, and the second user interface element includes a visual element.

3. The radio device of claim 1, wherein the first radiating slot is one of a quarter wavelength slot antenna or a half wavelength slot antenna.

4. The radio device of claim 3, wherein the antenna element wraps around three sides of the radio device.

5. The radio device of claim 4, wherein the radio device is intended to be worn on a user's body in an orientation such that an electric field of the first radiating slot is polarized substantially perpendicular with respect to a surface of the user's body when the radio device is worn normally on the user's body.

6. The radio device of claim 5, wherein the radio device is a wireless earpiece, and wherein the first user interface component comprises at least one button which protrudes from the device through the first radiating slot.

7. The radio device of claim 1, wherein the second radiating slot is formed for at least one of polarity diversity or operating frequency diversity.

8. The radio device of claim 1, wherein the first radiating slot is fed from the circuit module by a spring contact.

9. The radio device of claim 1, wherein the third user interface element comprises button.

10. A housing for a radio device, comprising:

a conductive portion enclosing circuitry of the radio device;

the conductive portion having two opposing coplanar electrically conductive surfaces, each of the surfaces having opposing edges forming a first radiating slot having a "U" shape around the housing and tuned to an operating frequency of the radio device;

the first radiating slot configured to allow operation of a user interface component of the radio device through the first radiating slot; and a second radiating slot formed on the two opposing surfaces and across one side of the device and having a "U" shape that interlocks with the first radiating slot.

11. The housing of claim 10, wherein the opposing edges of the opposing conductive surfaces retain a circuit module within the housing.

12. The housing of claim 10, wherein the user interface element includes a button.

13. The housing of claim 10, wherein the first radiating slot has a slot length substantially equivalent to one of a quarter wavelength or a half wavelength of an operating frequency of the radio device.

14. The housing of claim 10, wherein the second radiating slot is formed for a different operating frequency that the first radiating slot.

15. The housing of claim 14, wherein a second user interface component is accessible through the second radiating slot.

16. The housing of claim 10 further comprising at least one non-radiating opening formed in one of the opposing surfaces and configured to provide operation of a second user interface element through the non-radiating opening.

17. A wireless earpiece communications accessory device, comprising:

a first antenna element having a slot and forming a slot antenna, wherein the first antenna element is comprised of a flexible circuit board having a first radiating slot formed therein as an internal antenna element, and a second antenna element formed by a second radiating slot in a conductive portion of a housing of the wireless earpiece;

a circuit module, the flexible circuit board attached to a circuit board of the circuit module at an attachment point; and at least one user interface element disposed on the circuit module, and the flexible circuit board folded over the attachment point such that the at least one user interface element is operable by a user through the first radiating slot in the flexible circuit board.

18. The device of claim 17, further comprising at least one non-radiating opening formed in the conductive portion of the housing for providing operation of an additional user interface element disposed on the circuit module through the non-radiating opening.

19. The device of claim 17, wherein when the device is worn on a user's body the device is in an orientation such that the second radiating slot is polarized with respect to the user's body.

20. The device of claim 17, wherein the second radiating slot is a wrapped slot antenna formed around the device.

* * * * *